US010716724B2

(12) United States Patent
Vrzalik et al.

(10) Patent No.: US 10,716,724 B2
(45) Date of Patent: Jul. 21, 2020

(54) MOISTURE CONTROL SYSTEM

(71) Applicant: Huntleigh Technology Limited, Dunstable (GB)

(72) Inventors: John H. Vrzalik, San Antonio, TX (US); Mathew Pickering, San Antonio, TX (US); Kz Hong, San Antonio, TX (US)

(73) Assignee: Huntleigh Technology Limited, Bedfordshire (GB)

( * ) Notice: Subject to any disclaimer, the term of this patent is extended or adjusted under 35 U.S.C. 154(b) by 432 days.

(21) Appl. No.: 15/529,229

(22) PCT Filed: Nov. 24, 2015

(86) PCT No.: PCT/US2015/062495

§ 371 (c)(1),
(2) Date: May 24, 2017

(87) PCT Pub. No.: WO2016/086030

PCT Pub. Date: Jun. 2, 2016

(65) Prior Publication Data

US 2017/0354557 A1 Dec. 14, 2017

Related U.S. Application Data

(60) Provisional application No. 62/083,521, filed on Nov. 24, 2014.

(51) Int. Cl.
*A61G 7/057* (2006.01)
*A47C 27/00* (2006.01)

(52) U.S. Cl.
CPC ..... *A61G 7/05784* (2016.11); *A47C 27/006* (2013.01); *A61G 7/057* (2013.01);
(Continued)

(58) Field of Classification Search
CPC ..... A61G 7/05784; A61G 7/057; A61G 2203/30; A61G 2203/46; A61G 2210/70; A47C 27/006
See application file for complete search history.

(56) References Cited

U.S. PATENT DOCUMENTS 6,148,461 A * 11/2000 Cook ..... A61G 7/05769 5/706
7,000,276 B2 * 2/2006 Chaffee ..... A47C 4/54 5/654

(Continued)

FOREIGN PATENT DOCUMENTS

GB 2014-E17178 * 3/2014 ..... A61G 7/057
WO 2014036472 A1 3/2014

OTHER PUBLICATIONS

Hong, KZ, and Vrzalik, John; "Effective Microclimate Management via a Powered Coverlet Using Novel Negative Pressure-Generated Airflow"; Kinetic Concepts, Inc., Clinical Symposium on Advances in Skin and Wound Care, Sep. 2011.

*Primary Examiner* — Robert G Santos
*Assistant Examiner* — Rahib T Zaman
(74) *Attorney, Agent, or Firm* — The Webb Law Firm

(57) ABSTRACT

A moisture control system includes a moisture control coverlet (10) and a fluid pump (18). The moisture control coverlet (10) includes a fluid pathway therein for moisture removal fluid. The fluid pump (18) is coupled to the fluid pathway for pumping fluid out of the fluid pathway by negative pressure at a fluid pump rate. The fluid pump rate can be adjustable and/or can be greater than 1 CFM.

17 Claims, 6 Drawing Sheets

(52) U.S. Cl.
CPC ..... *A61G 2203/30* (2013.01); *A61G 2203/46* (2013.01); *A61G 2210/70* (2013.01)

(56) References Cited

U.S. PATENT DOCUMENTS

| | | | | |
|---|---|---|---|---|
| 7,424,760 | B2 * | 9/2008 | Chaffee | A47C 4/54 5/644 |
| 7,913,332 | B1 * | 3/2011 | Barnhart | A47C 21/044 5/421 |
| 7,914,611 | B2 * | 3/2011 | Vrzalik | A47C 21/044 5/652.1 |
| 8,118,920 | B2 | 2/2012 | Vrzalik et al. | |
| 8,372,182 | B2 | 2/2013 | Vrzalik et al. | |
| 8,826,478 | B2 * | 9/2014 | Chaffee | A47C 27/082 5/655.3 |
| 8,919,830 | B2 * | 12/2014 | Norton | B01L 1/02 292/143 |
| 2011/0131725 | A1 * | 6/2011 | Stroh | A61G 7/05776 5/600 |
| 2012/0167303 | A1 * | 7/2012 | Stroh | A47C 27/006 5/484 |

* cited by examiner

MOISTURE CONTROL SYSTEM

CROSS-REFERENCE TO RELATED APPLICATIONS

This application is the United States national phase of International Application No. PCT/US2015/062495 filed Nov. 24, 2015, and claims priority to U.S. Provisional Patent Application No. 62/083,521 filed Nov. 24, 2014, the disclosures of which are hereby incorporated in their entirety by reference.

FIELD OF INVENTION

The present disclosure relates to moisture control systems and methods of moisture control.

BACKGROUND

Conventional microclimate control systems typically are unable to remove significant amount of liquid from the vicnitiy of a patient, as may be needed for patients who suffer from incontinence, and/or are not designed to provide an effective means for adjustably drawing liquid and moisture from a patient while avoiding excessive cooling of a patient. As such, there is a need to develp a system that may facilitate rapid evaporation/removal of liquid and/or moisture while regulating heat loss of the patient.

SUMMARY

Embodiments of the present disclosure relate to an improved moisture control system and related method.

According to an aspect of the present disclosure, there is provided a moisture control system, including: a moisture control coverlet including a fluid pathway therein for moisture removal fluid; and a fluid pump coupled to the fluid pathway for pumping fluid out of the fluid pathway by negative pressure at a fluid pump rate, wherein the fluid pump rate is adjustable.

For example, the fluid pump includes an adjustment element for adjusting the fluid pump rate.

Embodiments are able to remove moisture and/or liquid from a patient at a treatment zone. However, while existing devices can be self-regulating in terms of moisture removal, embodiments of the invention are able to reduce the fluid pump rate if a patient complains of being too cold. This has been found to reduce the heat transfer from the patient and thereby reduce cooling.

An advantage of embodiments of the present disclosure is the option of reducing fluid flow if the patient complains of being too cold on the product. Standard coverlets are self-regulating in moisture removal, but not self-regulating in temperature reduction caused by conductive and convective heat transfer. Reducing the absorption of heat from the patient can be achieved in embodiments of the present disclosure by reducing air flow rate through a spacer material of the coverlet.

According to an aspect of the present disclosure, there is provided a moisture control system, including: a moisture control coverlet including a fluid pathway therein for moisture removal fluid; and a fluid pump coupled to the fluid pathway for pumping fluid out of the fluid pathway by negative pressure at a fluid pump rate, wherein the fluid pump is operable to pump fluid at a fluid pump rate of at least 1 CFM (cubic feet per minute).

Prior art systems are able to remove moisture in the form of vapour from a patient's skin. While this can be effective where a patient perspires, in some situations a patient may suffer from incontinence and prior art systems are generally not able to remove liquid incontinence. Example embodiments of the present disclosure provide a greatly increased fluid flow rate and fluid velocity through the system which greatly increases the moisture vapour transfer rate (MVTR) and enables the system to remove significant volumes of liquid from the vicinity of a patient, including liquid incontinence.

However, increased fluid flow rate can result in excessive cooling of a patient. Example embodiments of the present disclosure also provide an adjustable fluid pump rate to allow for the fluid flow rate to be reduced where it is causing a patient to feel uncomfortably cool or cold. As described above, a reduced fluid flow rate has been found to reduce the cooling of a patient.

In embodiments, the fluid is air.

Embodiments of the present disclosure provide a three layer support system or coverlet including a top layer for receiving a patient, a middle layer or spacer through which air can pass, and a bottom layer.

In such systems, MVTR is a function of the vapour permeability of the top layer of the support system and the velocity of the air passing through the spacer, or middle layer of the support system. Since the MVTR of the top layer is a fixed value for a given material, once the material for the top layer is selected the vapour permeability of the top layer cannot be varied. MVTR from the patient can be increased by increasing the air flow rate through the spacer. When the air flow rate is increased, MVTR from the patient increases through higher evaporation rate. As a result of this higher evaporation rate, additional evaporative cooling of the patient occurs, which can cause the patient to be cool or cold. However, after the desired moisture vapour removal has occurred, the air flow rate can be reduced.

Temperature reduction is a desirable feature during the time that perspiration moisture is being removed. This evaporative cooling occurs at a relatively high rate while the patient is perspiring (skin relative humidity —RH— 100%). When perspiration stops (skin RH less than 100%), evaporative cooling tapers off and almost stops. However, cooling from conduction and convection continues with heat transferring from the patient, through the top cover, into the spacer material, and is carried away by the air flow. Heat loss (conductive and convective) from the patient is much less than the heat loss from evaporation during perspiration, but conductive and convective heat loss can cause a patient to feel cool or cold.

Embodiments of this invention provide high air flow for high evaporative moisture loss, but if the conductive and convective heat loss is sufficient to cause the patient to be uncomfortably cool, the air flow can be reduced by reduced air flow through the spacer material. These features, (i.e., increasing MVTR when needed with higher air flow and then reducing air flow when the higher MVTR is not needed), provide advantageous features to embodiments of the present disclosure.

Embodiments of the present disclosure increase the MVTR from the patient to levels that to the inventors' knowledge have not been accomplished in the past with existing low air loss support surfaces or any type of existing coverlet. The high air flow results in much higher cooling rates for the patient. Once evaporative cooling stops when all perspiration is evaporated, cooling from conduction and convective cooling continues until patient cools to a comfortable level. Then the air flow rate can be reduced to maintain the patient at a comfortable temperature.

This high air flow rate is beneficially accomplished using negative pressure air flow. With positive pressure air flow, the top layer would separate from the spacer. In other words, the top layer would billow up, which is undesirable, and air velocity would not increase to a level to produce high MVTR.

Embodiments of the present disclosure provide a fluid flow rate and air velocities within the system of the order of ten times that of some existing systems.

Embodiments of the present disclosure add air flow rate adjustability to a coverlet with a fixed air flow rate. The flow rate change is only in the reduced air direction.

Embodiments include at least one flow restriction member configurable to selectively restrict the flow of fluid pumped by the fluid pump whereby to adjust the fluid pump rate.

In example embodiments, the at least one flow restriction member is a plurality of flow restriction members each individually configurable to selectively restrict the flow of fluid pumped by the fluid pump.

In embodiments, the, each, or at least one of, the at least one flow restriction member includes an adjustable cover for an exhaust opening or vent on the fluid pump. The or each cover can be configurable into a closed position to restrict the flow of fluid pumped by the fluid pump, or into an open position in order not to restrict the flow of fluid pumped by the fluid pump. In some embodiments, the or each cover can be configurable into a partially closed position to restrict the flow of fluid pumped by the fluid pump to a lesser degree than the restriction provided by the closed position.

Data shows that as fluid flow is reduced by closing off exhaust vents, heat removal from a patient is also reduced, resulting in a lesser reduction in skin temperature. If a patient feels uncomfortably cool, embodiments of the present disclosure enable the amount of heat transferred from the patient to the fluid flow in the coverlet to be reduced.

The at least one flow restriction member may be configurable in a plurality of different configurations, each configuration providing a different restriction to the flow of fluid. Each configuration may include none, one, or more than one flow restriction member configured to restrict the flow of fluid pumped by the fluid pump and none, one, or more than one flow restriction member configured not to restrict the flow of fluid pumped by the fluid pump.

In example embodiments, each flow restriction member may be configurable in a plurality of different configurations, each configuration providing a different restriction to the flow of fluid.

In example embodiments, the fluid pump is operable to pump fluid at a fluid pump rate of at least 1 CFM (cubic feet per minute), more preferably at least 6 CFM, even more preferably at least 10 CFM, and even more preferably at least 20 CFM or at least 30 CFM. In some embodiments, the fluid pump can be operated at about 12 CFM or about 35 CFM.

In example embodiments, the fluid pump can also be operated at a lower fluid pump rate, for example below 1 CFM where the cooling of the patient is to be reduced.

In example embodiments, when one or more fluid restriction members are restricting the flow of fluid, the fluid pump rate can be below or above 1 CFM.

It has been found that negative pressure airflow at 12 CFM can produce an MVTR of about 450 gm/m$^2$/hr while positive pressure air flow up to 8 CFM produces an MVTR of less than 100 gm/m$^2$/hr. This data is shown in FIG. 17, which is from "Effective Microclimate Management via a Powered Coverlet Using Novel Negative Pressure-Generated Airflow" KZ Hong PhD and John Vrzalik BSME, Kinetic Concepts Inc., Clinical Symposium on Advances in Skin and Wound Care, September 2011, which is incorporated herein by reference. Embodiments can achieve MVTRs of 600 or 700 gm/m$^2$/hr with a fluid flow rate in the order of 30 or more cubic feet per minute.

Some embodiments include a variable power supply operable to supply power to the fluid pump. Where the pump includes a fan, varying the power supplied to the pump can vary the fan speed.

In embodiments, the power supply is configurable to supply power at a plurality of different power levels. For example, the power supply can have a power selection element for selecting a level of power supplied.

In embodiments, the power supply can be switched on and off repeatedly in a variable duty cycle to reduce/control the fluid flowing through the coverlet.

The system can include a control unit operable to adjust the fluid pump rate. This can be by operating the power supply and/or configuring the at least one flow restriction member to restrict or derestrict fluid flow.

The system can include a sensor for sensing a condition at a treatment zone, the sensor being configured to sense one or more of temperature and humidity; wherein the control unit is operable to adjust the fluid pump rate in response to a condition sensed by the sensor. The treatment zone can be at a patient's skin or in the vicinity of a surface of the coverlet.

According to an aspect of the present disclosure, there is provided a method of moisture control, including: operating a fluid pump of a moisture control coverlet to pump fluid out of a fluid pathway in the moisture control coverlet by negative pressure at a first fluid pump rate; in response to a reduction in one or more of temperature and humidity at a treatment zone, operating the fluid pump to pump fluid out of the fluid pathway by negative pressure at a second fluid pump rate, wherein the second fluid pump rate is less than the first fluid pump rate.

Preferably, the first fluid pump rate is at least 1 CFM or greater as described above.

According to an aspect of the present disclosure, there is provided a method of moisture control, including: operating a fluid pump of a moisture control coverlet to pump fluid out of a fluid pathway in the moisture control coverlet by negative pressure at a first fluid pump rate at least 1 CFM.

The method can include varying a pump rate of the fluid pump to provide a controlled temperature reduction at the treatment zone.

In embodiments, operating the fluid pump to pump fluid out of the fluid pathway by negative pressure at a second fluid pump rate includes configuring at least one flow restriction member to restrict the flow of fluid pumped by the fluid pump.

In example embodiments, the at least one flow restriction member is a plurality of flow restriction members and configuring at least one flow restriction member to restrict the flow of fluid pumped by the fluid pump includes configuring each flow restriction member to provide a desired restriction to the flow of fluid, which can include configuring each flow restriction member to restrict the flow of fluid pumped by the fluid pump.

The at least one flow restriction member may be configurable in a plurality of different configurations, each configuration providing a different restriction to the flow of fluid. Each configuration may include none, one, or more than one flow restriction member configured to restrict the flow of fluid pumped by the fluid pump and none, one, or more than one flow restriction member configured not to restrict the flow of fluid pumped by the fluid pump.

In embodiments, each flow restriction member may be configurable in a plurality of different configurations, each configuration providing a different restriction to the flow of fluid.

In embodiments, operating the fluid pump to pump fluid out of the fluid pathway by negative pressure at a second fluid pump rate includes adjusting a power supplied to the fluid pump. Adjusting a power supplied to the fluid pump can include changing a level of power supplied. However, it can also or alternatively include repeatedly switching the power on and off.

Embodiments of the present disclosure provide a multi-layer support system with aggressive moisture vapour removal and adjustable or variable air flow rate.

BRIEF DESCRIPTION OF THE DRAWINGS

Embodiments of the present disclosure are described below, by way of example only, with reference to the accompanying drawings, in which.

DETAILED DESCRIPTION OF DISCLOSED EMBODIMENTS

Figure 1:
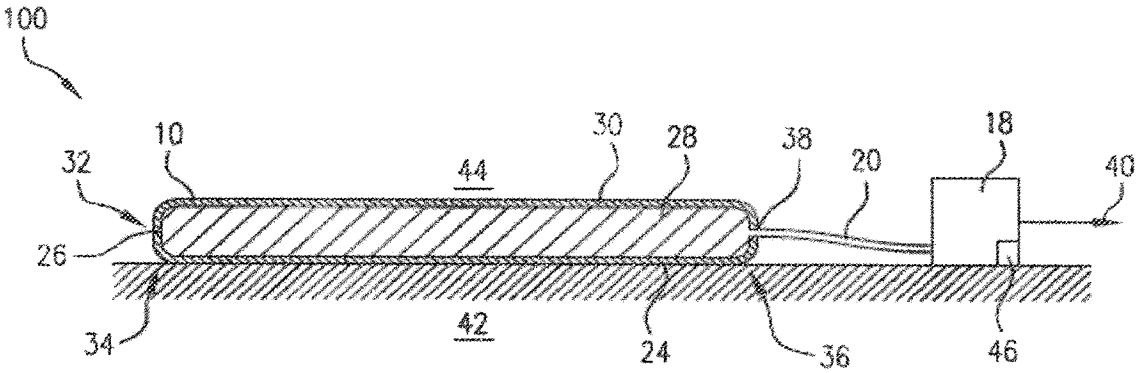
FIG. 1 is a schematic side sectional view of a moisture control system according to an embodiment of the present disclosure.

FIG. 1 shows a schematic cross-section of a moisture control system 100 according to an embodiment of the present disclosure.

The moisture control system 100 includes a coverlet 10 and fluid pump 18. The fluid pump 18 is in this embodiment coupled to the coverlet 10 by a flexible conduit such as a tube 20. However, in other embodiments, the fluid pump 18 can be mounted directly onto the coverlet 10.

In this embodiment, the fluid pump is an air pump for pumping air.

In this embodiment, the coverlet includes three layers, a first layer 30, second layer 28 and third layer 24. The first layer 30 is vapour permeable, liquid impermeable, and either air permeable or impermeable. The second layer 25 is sandwiched between and separates the first and third layers and is a spacer material that allows air to flow through it under negative pressure. A spacer material can be any material that includes a volume of air within the material and allows air to move through the material. The third layer 24 comprises a material that is vapour impermeable, air impermeable and liquid impermeable.

The first layer and third layer are connected at a permeable interface 26 that is highly air permeable to allow air flow created by the fluid pump 18 to cause air flow into the second layer 28 through the permeable interface 26 essentially unrestricted as shown by the arrow 32.

Permeable interface 26 exists only at an end 34 of the coverlet 10 opposite an end 36 where the fluid pump 18 is coupled to the coverlet 10. At the end 36, the first and third layers are joined together and an aperture 38 is provided in the first and/or third layers by which the fluid pump 18 is coupled to the second layer 28. In this embodiment, this is by the conduit 20 being coupled to the aperture 38.

Along sides of the coverlet 10 between the ends 34 and 36, and the first and third layers are joined together in a non-permeable manner.

In this way, a fluid pathway is provided by the permeable interface 26, the second layer 28 and the aperture 38 so that air can flow into the permeable interface 26, through second layer 28, and out via the fluid pump 18 as shown by arrow 40. In embodiments in which the first layer is air permeable, the fluid pathway can also include the first layer as air can flow into the second layer through the first layer.

The system 100 is placed on a support surface 42, typically a mattress of a bed, although it can be a chair or other support surface. The system is arranged on the support surface 42 so that the third layer 24 is adjacent to the support surface 42.

The system 100 is designed for a patient to lie or sit in a treatment zone 44 which is adjacent to the first layer 30.

The fluid pump 18 includes a power supply 46. The power supply is variable so as to be operable to supply power to the fluid pump 18 at any one of a plurality of power levels. The power supply for example includes a power selection element for selecting a level of power supply.

In addition, the fluid pump 18 includes a plurality of flow restriction members configurable to selectively restrict the flow of air pumped through the system 100. In this embodiment, the flow restriction members are vent covers as described with respect to FIG. 3.

Figure 3:
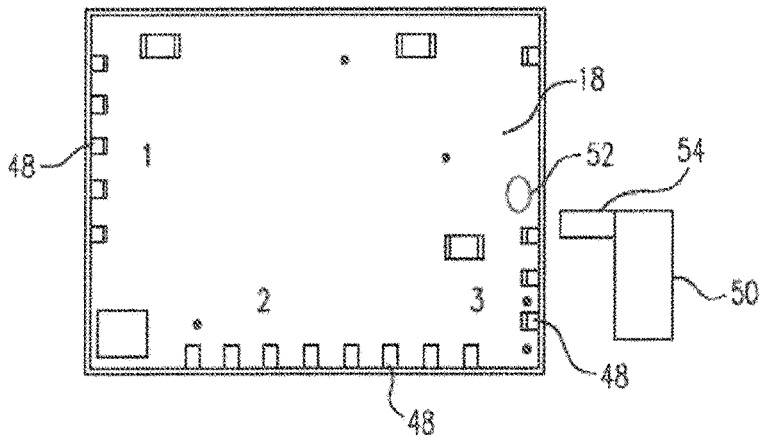
FIG. 3 is a schematic view of a pump housing for use in embodiments of the present disclosure.

FIG. 3 shows an end view of the fluid pump 18 in which can be seen a plurality of vents 48. In this embodiment, the fluid pump 18 includes a fan which draws air through the conduit 20 and expels it via the vents 48.

The system includes covers 50 which can be placed at least partly over each vent 48 to obstruct air flow through the vent. Although FIG. 3 only shows one cover 50, there will typically be provided one cover 50 for each vent 48. It is not excluded that covers are provided for only some of the vents or that vents include multiple covers for different parts of the vent.

Each vent 48 has associated with it a coupling member 52 which is operable to cooperate with a corresponding coupling member 54 on the associated cover 50 arranged so that when the coupling member 52 cooperates with a corresponding coupling member 54 on the associated cover 50, that associated cover 50 at least partially covers the vent 48. The coupling members 54 on the covers 50 can be releasably coupled to respective coupling members 52 on the fluid pump 18.

When a cover is coupled to the fluid pump 18, the cover 50 will typically completely cover the corresponding vent 48 whereby to obstruct air being expelled via that vent 48 and thereby restrict the flow of air through the system 100. However, it is not excluded that the cover 50 can cover only part of the associated vent 48.

The covers 50 can be coupled to the fluid pump 18 so as to cover the vents 48 in a plurality of combinations. Each different combination affects the fluid flow through the system to a different degree, and results in the system providing a different amount of cooling to the treatment zone 44.

Figure 4:
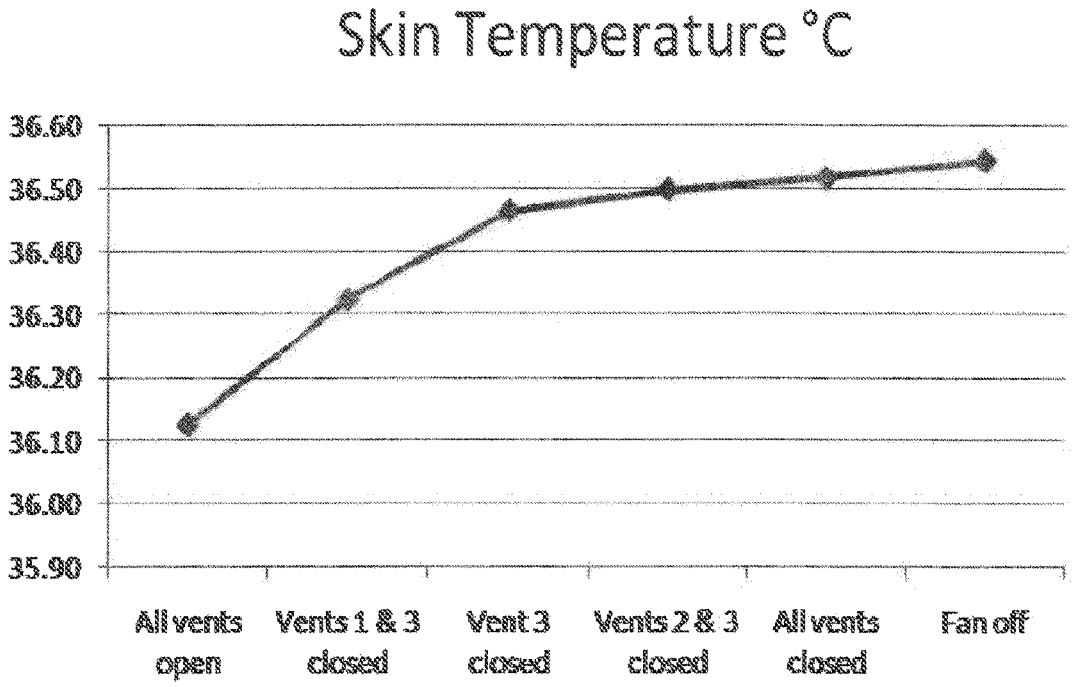
FIG. 4 is a graph showing the effect on skin temperature of different configurations of a pump in an embodiment of the present disclosure.

The vents in FIG. 3 are labelled 1, 2 and 3. As an illustration of the different degrees of cooling provided by the different combinations of fan covers, the table below shows the results on the skin temperature of a patient where that patient is lying in the treatment zone 44 and the fluid pump 18 is operated in various different combinations of vent coverings. These results are also depicted in graph form in FIG. 4.

| Fan Air Restriction | Skin T, ° C. |
|---|---|
| All vents open | 36.12 |
| Vents 1 & 3 closed | 36.32 |
| Vent 3 closed | 36.46 |
| Vents 2 & 3 closed | 36.50 |
| All vents closed | 36.52 |
| Fan off | 36.54 |

Although the depicted embodiment includes a pump with a fan and vents, other forms of pump can be used, and these other pumps may include other forms of exhaust outputs. Furthermore, the flow restriction members do not need in all embodiments to be in the fluid pump 18. They can be provided in the fluid pathway in the coverlet 10 for example. However, in all embodiments, there is at least one flow restriction member which can be selectively configured to restrict the flow of fluid pumped by the fluid pump.

Figure 2:
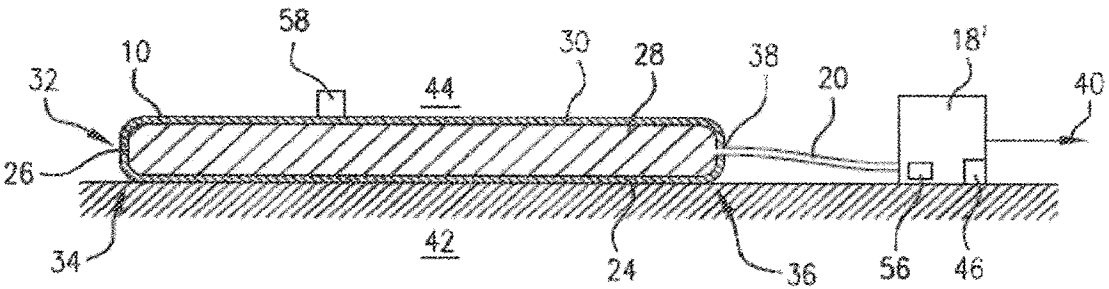
FIG. 2 is a schematic side sectional view of a moisture control system according to an embodiment of the present disclosure.

FIG. 2 depicts another embodiment, which corresponds in many respects to the embodiment of FIG. 1. However, in this embodiment, the fluid pump 18' includes a control unit 56 and there is a sensor 58 in the treatment zone 44. The sensor 58 can be a sensor of temperature or humidity or both. In this embodiment, it is a temperature sensor.

The sensor 58 is in signal communication with the control unit 56 and is configured to provide readings, in this case of temperature, to the control unit 56.

It is to be noted that although the control unit 56 is in this embodiment in the fluid pump, this is not necessary in all embodiments. It can be a separate device or incorporated in a separate device, such as a computer. However, the control unit 56 is configured to control the operation of the fluid pump 18'. It is to be appreciated that the functionality of the control unit may be incorporated as code (such as a software algorithm or program) residing in firmware and/or on computer useable medium having control logic for enabling execution on a computer system having a computer processor. Such a computer system typically includes memory storage configured to provide output from execution of the code which configures a processor in accordance with the execution. The code can be arranged as firmware or software, and can be organized as a set of modules such as discrete code modules, function calls, procedure calls or objects in an object-oriented programming environment. If implemented using modules, the code can comprise a single module or a plurality of modules that operate in cooperation with one another.

The control unit 56 is operable to control the power supplied to the fluid pump 18'. In addition, in this embodiment, the covers are attached to the fluid pump 18' and are movable by the control unit between an open configuration in which they do not cover their associated vent so their associated vent is open, and a closed configuration in which they cover their associated vent. In some embodiments, the covers are also movable into intermediate positions in which they partially cover their associated vent.

The covers can be coupled to the fluid pump by a hinged member, which hinged member can be moved by a motor which is controlled by the control unit 56.

The control unit 56 is configured to vary the power supplied to the fluid pump 18' and/or to vary the flow restrictions provided by the covers in response to readings received from the sensor 58. In this way, the control unit 56 can provide a controlled temperature reduction to the treatment zone 44.

In one embodiment, the control unit 56 is programmed with one or a plurality of thresholds and is configured to provide a predetermined power to the pump 18' and/or a predetermined configuration of the covers in dependence on the temperature measured by the sensor 58, with respect to the one or more thresholds. For example, the control unit 56 can be configured to reduce the power supplied to the pump 18' and/or increase the flow restriction provided by the covers 50 in response to the temperature as measured by the sensor 58 falling below a threshold.

In the embodiment of FIG. 1, in use, a patient sits or lies in the treatment zone 44. The presence of the patient at the treatment zone results in the presence of liquid or moisture in the treatment zone 44, whether by way of perspiration of the patient or liquid incontinence.

An operator, such as a nurse or other practitioner, operates the fluid pump 18 at an appropriate level depending on the amount of liquid or moisture present in the treatment zone. An appropriate pumping rate can be selected by appropriate selection of the power supplied to the fluid pump 18 by the power supply 46 and/or by appropriate closing and/or opening of vents 48 of fluid pump 18.

Advantageously, the fluid pump can be operated to pump fluid using negative pressure air flow at a pump rate of at least 1 CFM, more preferably at least 10 CFM and even more preferably at least 20 CFM but can also be adjusted to provide a pump rate of less than 1 CFM by operation of the power supply and/or configuration of the covers as described below.

Figure 17:
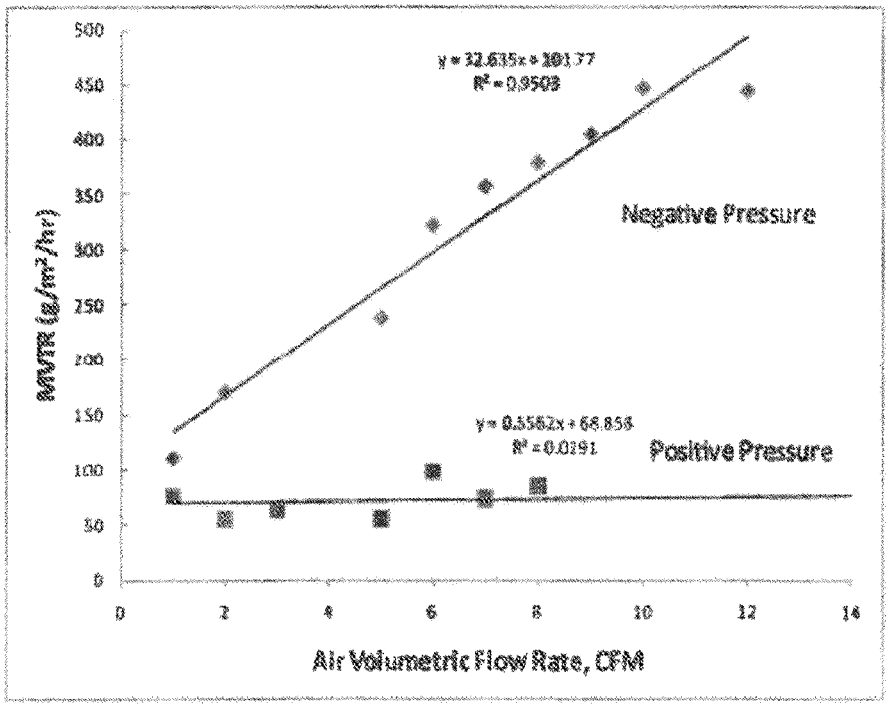
FIG. 17 is a graph illustrating advantages of negative pressure airflow.

When pumped at a high pump rate, the air velocity in the fluid pathway of the system is significantly increased. Furthermore, by using negative pressure air flow, the coverlet is prevented from ballooning or blowing up in response to the increased air flow, which would otherwise prevent the increase in air velocity. This is illustrated in FIG. 17. The increase in air velocity is advantageous to increase MVTR as described below.

Liquid at the treatment zone evaporates and vapour from the liquid or moisture at the treatment zone 44 diffuses through the first layer 30 into the second layer 28. However, this will primarily occur when the relative humidity of the air in the second layer 28 is less than the relative humidity of the air in the treatment zone 44. However, as the fluid pump 18 is operated, the air in the second layer 28 is pumped out through the fluid pathway and out of the fluid pump 18 in the direction of the arrow 40 taking vapour with it, and it is replaced with new air through the interface 26 in the direction of arrow 32, and/or through the first layer 30 in embodiments in which the first layer 30 is air permeable. This movement of air keeps the relative humidity in the second layer 28 low, allowing the evaporation of the liquid and the diffusion of vapour through the first layer 30 to continue.

An advantage of embodiments of the present disclosure is that because of the high pump rate of the fluid pump 18 the air in the second layer 28 has a high velocity and can dry, or evaporate, significant quantities of liquid from the treatment zone 44, such as that resulting from liquid incontinence. The high air velocity enabled by the high pump rate and the use of negative pressure fluid flow enables moisture to be quickly carried away from the treatment zone in the form of vapour by the air flow, maximising moisture vapour transfer rate from a patient in the treatment zone.

Figure 5:
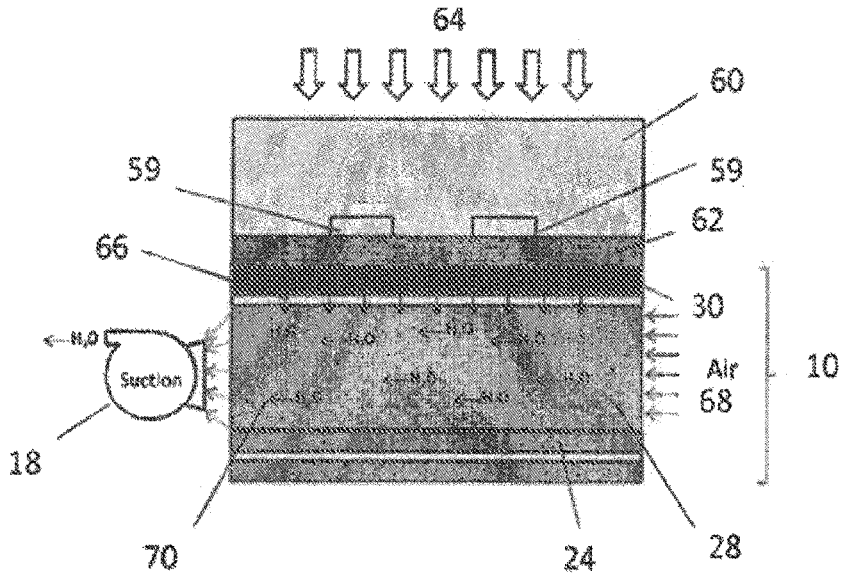
FIG. 5 is a schematic cross section showing the operation of a system according to an embodiment of the present disclosure using a sweating hot plate.

FIG. 5 illustrates a process for testing a coverlet 10. In FIG. 5, a sweating hot plate 60 is placed on a towel 62 in the treatment zone 44 of a coverlet 10. In this case two temperature sensors 59 are provided in the sweating hot plate 60.

The temperature sensors 59 are configured to maintain the sweating hot plate temperature at a predetermined temperature, in this case 35 degrees C. The temperatures sensors 59 are built into sweating hot plate device. When cooling is caused by evaporation, conduction, and/or convection, the sensors 59 detect a reduction in temperature (below 35° C.), and increase heat supply 64 to maintain 35 C at sweating hot plate.

When testing, a dry test (towel 62 is tested dry) is performed first to measure heat loss by conduction and convection. Then a "wet" test is performed with towel 62 completely saturated to ensure 100% relative humidity.

In the dry test, the heat 64 required to maintain sensors 59 at constant 35° C. is heat loss from convection and conduction. In the wet test, heat 64 required to maintain sensors 59 at 35° C. is a combination of conduction, convection, and evaporative (latent heat of evaporation).

In the dry test, heat 64 is provided by the sweating hot plate. In the second layer 28, air 68 is drawn by the pumping of fluid pump 18 out of the system 100. This removes, by conduction and convection, temperature from the sweating hot plate and this change of temperature is detected by the temperature sensors 59.

In the wet test, when heat 64 is provided by the sweating hot plate, moisture in the wet towel 62 is evaporated and diffuses through the first layer 30 as shown by the arrows 66. This vapour passes into the second layer 28. In the second layer 28, air 68 drawn by the pumping of fluid pump 18 draws the vapour out of the second layer 28 as shown by the arrows 70 and out of the system 100. This removes, in particular by way of the latent heat of evaporation, but also by conduction and convection, temperature from the sweating hot plate and this change of temperature is detected by the temperature sensors 59.

The difference in heat in the wet and dry tests is the heat losses due to evaporation. This heat difference is used to calculate grams of water evaporated over the area of the sweating hot plate. With that, moisture vapor transfer rate, MVTR, is calculated in grams of water evaporated per sq. meter per hour.

This test is much better than the Reger method. The Reger method starts with a wet towel and no more water is added for the duration of the test. In a high MVTR system, the Reger towel can dry completely, so RH drops drastically during the test, giving false, low MVTR for the best support systems. In contrast, in the sweating hot plate method, the interface between hot plate and support surface is continuously flooded with water to ensure it remains at 100% RH. Vapor transmission (evaporation) remains at maximum for the duration of the test, regardless of the evaporation, or vapor transmission rate of the support surface being tested.

Figure 7:
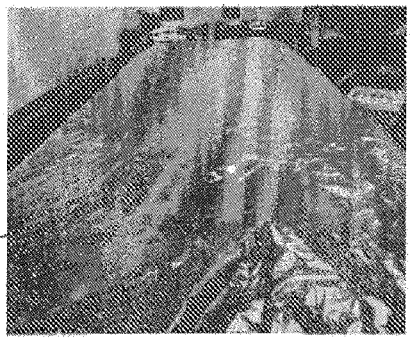
FIGS. 7 to 11 show a test using an embodiment of the present disclosure to remove water from a coverlet.
Figure 8:
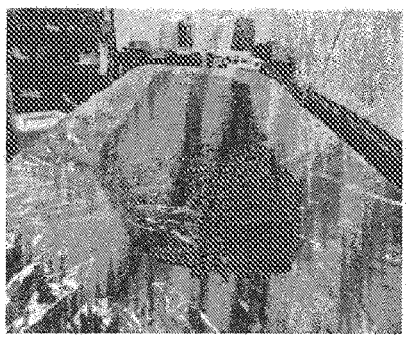
Figure 9:
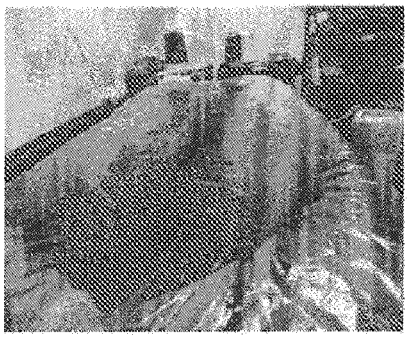
Figure 10:
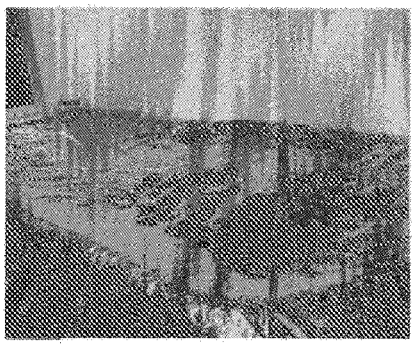
Figure 11:
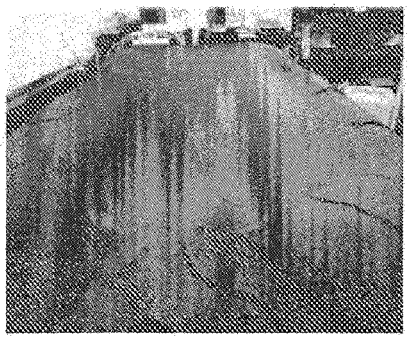

An example illustrating the efficacy of embodiments of the present disclosure is shown in FIGS. 7 to 11 in which a litre of water was placed into the treatment zone 44 of a coverlet which had been dammed up around the periphery. The coverlet was then covered with a plastic sheet 74 of water and vapour impermeable plastic to prevent evaporation upwardly. FIG. 7 shows the system as initially set up. When the test was started, the system was operated as described above with an air flow rate of about 12 CFM. FIG. 8 shows the system once the test had begun. FIG. 9 shows the system four hours into the test. FIG. 10 shows the system 6.5 hours into the test, and FIG. 11 shows the system 7.5 hours into the test with the plastic sheet 74 removed, showing that the litre of water was completely evaporated.

It is shown by this that the system is effective at removing significant volumes of liquid from the treatment zone 44 in a relatively limited amount of time. Indeed, the rate of liquid removal in the test shown in FIGS. 7 to 11 was greater than the rate that liquid would be produced by a patient at the treatment zone 44.

In general, the fluid pump 18 is operated at a high pump rate above 1 CFM, 10 CFM or 20 CFM as mentioned above, while there is liquid present in the treatment zone 44. This high pump rate provides a high moisture vapour transfer rate (MVTR) through a high evaporation and diffusion rate of liquid from the treatment zone 44 into the second layer 28 and a high velocity of air removing vapour from the second layer 28. This high evaporation rate causes cooling of the patient, which can cause the patient to be cool or cold. In response to the patient feeling cool or cold, the operator is able to adjust the pump rate of the fluid pump 18 to reduce the pump rate, and thereby reduce the cooling effect of the system.

In general, temperature reduction is a desirable feature during the time that liquid or moisture is being removed. Accordingly, the fluid pump 18 is generally operated at a high rate of above 1 CFM, 6 CFM or 20 CFM while a patient is perspiring, and has a skin relative humidity of 100%, or there is other liquid at the treatment zone 44.

However, when perspiration stops, in other words when the skin relative humidity has dropped below 100%, and all other liquid has been removed from the treatment zone 44, evaporative cooling tapers off and almost stops. However, there is additional cooling from conduction and convection resulting in heat transferring from the patient at the treatment zone 44 through the first layer 30 and into the second layer 28 where it is carried away by the airflow. While cooling as a result of conductive and convective heat loss is considerably less than evaporative cooling, if the patient begins to feel uncomfortably cool, the rate of pumping can be reduced, to below 1 CFM for example, to reduce the air velocity and thereby reduce the temperature cooling rate. In some embodiments a sensor 58 as described above can be provided in the embodiment of FIG. 1 to assist an operator with determining the temperature at the treatment zone and thereby the rate of fluid pumping needed.

Figure 6:
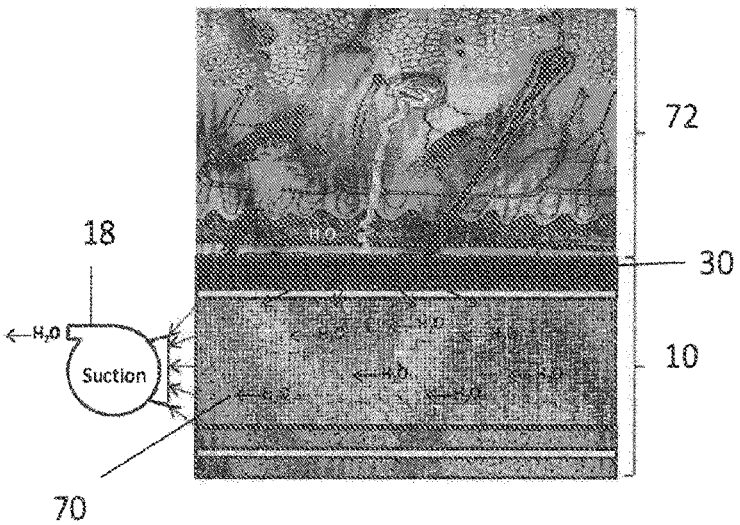
FIG. 6 is a schematic diagram showing operation of a system according to an embodiment of the present disclosure with a patient in a treatment zone.

FIG. 6 shows a set-up similar to FIG. 5, but for use on a patient, with the sweating hot plate and towel replaced by the patient's skin 72 which creates perspiration and heat to evaporate that perspiration and allow it to diffuse through the first layer 30.

Figure 6A:
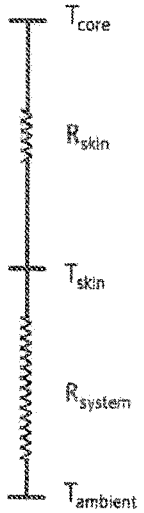
FIG. 6*a* is a schematic diagram showing temperature variation in the setup of FIG. 6.

FIG. 6A is a schematic illustrating temperatures and resistances to temperatures at different points. $T_{core}$ represents the core skin temperature of a patient. $R_{skin}$ represents a resistance to heat transfer, or an insulation quantity, of the skin. $T_{skin}$ represents a surface temperature of the skin. $R_{system}$ represents a resistance to heat transfer, or an insulation quantity, of the system of FIG. 6. $T_{ambient}$ represents the ambient temperature of the surroundings. The resistances are a function of a plurality of parameters, including conduction, convection, evaporation and radiation through the respective part. The greater the conduction, convection, evaporation and radiation through a material, the lower its resistance will be.

A heat flux between two points at temperatures $T_1$ and $T_2$ respectively can be determined by $(T_1-T_2)/R$ where R is the resistance between the two points.

In FIG. 6A, the skin temperature can be determined by the following equation $$T_{skin} = \frac{(T_{core} - T_{ambient}) \times R_{system}}{(R_{system} + R_{skin})} + T_{ambient}$$

Typically, the skin core temperature will be about 37° C. (98.6° F.), the ambient temperature will be about 25° C. (77° F.) and the skin resistance to heat transfer will be about 0.05 $m^{2\circ}$ K/W.

As can be seen from the equation above, if $R_{system}$ is increased, for example when the skin becomes dry without sweating and evaporation therefore decreases, and/or the air flow rate through the system decreases, the skin surface temperature will increase.

In the embodiment of FIG. 2, the control unit 56 monitors readings from the sensor 58 and operates the fluid pump 18' at a rate that is in keeping with the reading from the sensor 58. For example, the control unit 56 can be programmed with a set of fluid pump 18' configurations corresponding to a series of ranges of temperature measurements from the sensor 58. The control unit 56 can then operate the fluid pump 18' in the configuration that corresponds to the current reading from the sensor 58.

It is not necessary in all embodiments for both the power supply 56 and the flow restriction members to be configured to change the fluid pump rate of the fluid pump 18. In embodiments, only one or other of these features may be configurable in order to change the fluid pump rate. Furthermore, instead of, or in addition to, changing the power level of the power supply, the power supply can be repeatedly switched on and off to provide a desired fluid pump rate.

Figure 12:
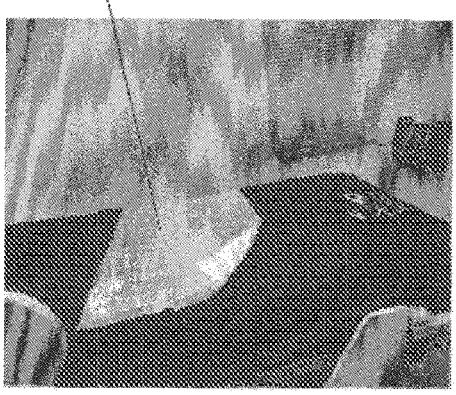
FIGS. 12 and 13 show an embodiment of the present disclosure with a disposable chuck over an incontinence coverlet.
Figure 13:
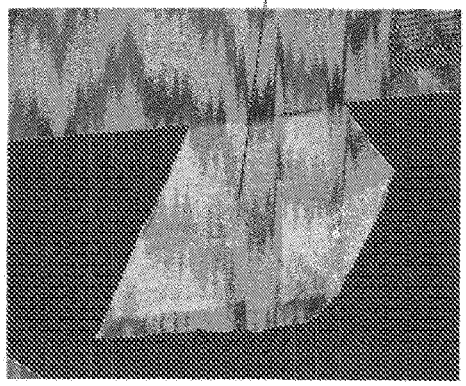

In some embodiments, a disposable chuck 80 can be placed in the treatment zone 44 such as shown in FIGS. 12 and 13. This can be especially beneficial where the system with coverlet and chuck is being used to absorb liquid from liquid incontinence since the chuck 80 can absorb most of the liquid and can be removed from the system so that the coverlet has to dry only the liquid incontinence that was not absorbed by the cluck.

Figure 14:
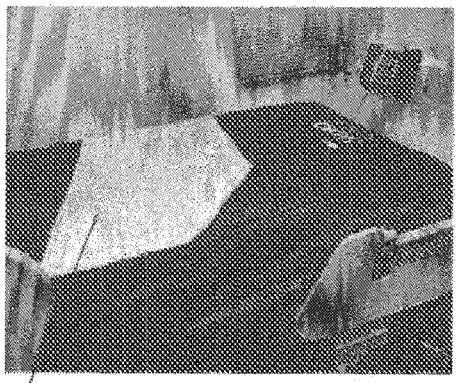
FIGS. 14 and 15 show an embodiment of the present disclosure with a reusable, launderable chuck over an incontinence coverlet.
Figure 15:
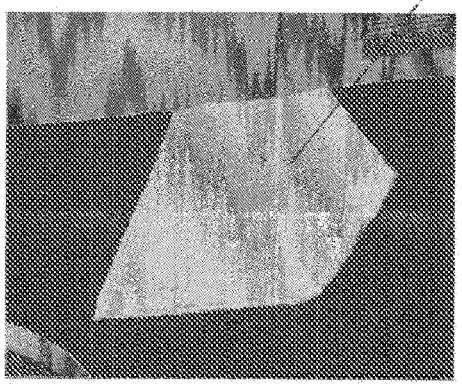

As shown in FIGS. 14 and 15 instead of a disposable chuck 80 a reusable launderable chuck 80' could additionally or alternatively be used.

Figure 16:
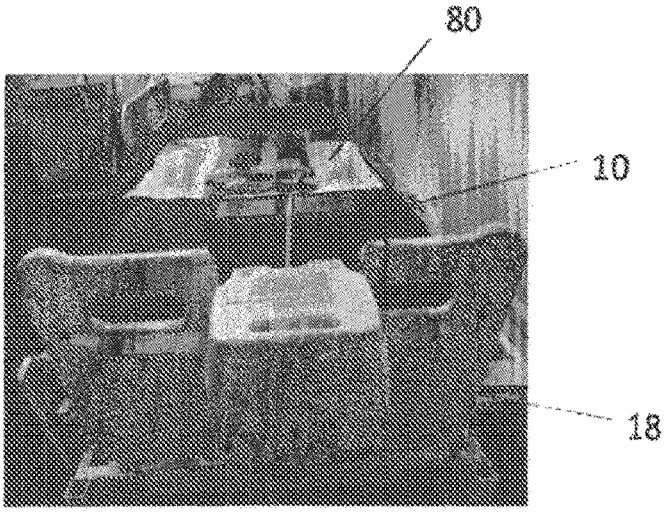
FIG. 16 shows a system according to an embodiment of the present disclosure.

FIG. 16 shows the Dr. Reger MVTR testing method measuring the moisture removal capability, or MVTR, of the disposable chuck 80.

Disposable chuck 80 and reusable chuck 80' are used to absorb, not evaporate, liquid, and collect solid incontinence. Either a disposable chuck 80 or a reusable chuck 80' can be used with coverlet 10 to absorb much of the liquid incontinence, but frequently, some of the liquid spills onto the support surface. With the use of coverlet 10 according to an embodiment of the present disclosure, the coverlet can remove this excess liquid incontinence much more rapidly than it could remove all the liquid incontinence if the chuck 80 or 80' were not used. But, the chuck should be removed from the sleep surface system, along with the liquid incontinence it has absorbed, to dry the treatment zone 44 more rapidly than if only coverlet 10 or chuck were used were used alone. The use of either chuck essentially stops the vapor transmission capability of the coverlet 10 from the area directly under the chuck, since the chuck is liquid and vapor impermeable. Therefore, the chuck should be removed after the liquid incontinence event for the coverlet to be most effective. With proper caregiver attention, the combined use of chuck 80 or 80' and coverlet 10 dries the treatment zone more rapidly than if either coverlet or chuck is used alone. However, if the chuck is not removed, the moisture vapor removal capability of the coverlet is compromised since the chuck cannot allow evaporation of liquid through its bottom layer, which is liquid and vapor impermeable.

The coverlet does not need exactly three layers. Other arrangements are possible. For example, possible configurations of the fluid pathway are provided in U.S. Pat. Nos. 8,372,182 and 8,918,930, the entirety of which are incorporated herein by reference herein. Details and modifications described therein are applicable to the coverlet described herein. However, other modifications may also be made to the configuration of the coverlet, provided the coverlet includes a fluid pathway through which the pump system can pump moisture removal fluid to remove moisture from the vicinity of a patient adjacent to the coverlet.

All optional and preferred features and modifications of the described embodiments and dependent claims are usable in all aspects of the invention(s) taught herein. Furthermore, the individual features of the dependent claims, as well as all optional and preferred features and modifications of the described embodiments are combinable and interchangeable with one another.

The foregoing description has been presented for the purpose of illustration and description only and is not to be construed as limiting the scope of the invention in any way. The scope of the invention is to be determined from the claims appended hereto. While devices, kits, systems and methods have been described with reference to certain embodiments within this disclosure, one of ordinary skill in the art will recognize that additions, deletions, substitutions and improvements can be made while remaining within the scope and spirit of the invention as defined by the appended claims.

The invention claimed is:

1. A moisture control system, comprising:

a moisture control coverlet including a fluid pathway therein for moisture removal fluid;

a fluid pump coupled to the fluid pathway for pumping fluid out of the fluid pathway by negative pressure at a fluid pump rate, wherein the fluid pump rate is adjustable; and at least one flow restriction member configured to selectively restrict a flow of fluid pumped by the fluid pump to adjust the fluid pump rate, wherein the at least one flow restriction member includes an adjustable cover plate couplable to an exterior end face of the pump to at least partially cover an exhaust opening or vent on the fluid pump.

2. The moisture control system according to claim 1, wherein the at least one flow restriction member is a plurality of flow restriction members each individually configured to selectively restrict the flow of fluid pumped by the fluid pump.

3. The moisture control system according to claim 1, wherein the fluid pump rate is at least 1 CFM.

4. The moisture control system according to claim 1, wherein the fluid pump rate is at least 6 CFM.

5. The moisture control system according to claim 1, wherein the fluid pump rate is at least 10 CFM.

6. The moisture control system according to claim 1, further comprising a variable power supply operable to supply power to the fluid pump.

7. The moisture control system according to claim 6, wherein the power supply is configured to supply power at a plurality of different power levels.

8. The moisture control system according to claim 1, further comprising a control unit operable to adjust the fluid pump rate.

9. The moisture control system according to claim 8, further comprising a sensor for sensing a condition at a treatment zone, the sensor being configured to sense one or more of temperature and humidity; wherein the control unit is operable to adjust the fluid pump rate in response to a condition sensed by the sensor.

10. A method of moisture control, comprising:

operating a fluid pump of a moisture control coverlet to pump fluid out of a fluid pathway in the moisture control coverlet by negative pressure at a first fluid pump rate; and operating the fluid pump to pump fluid out of the fluid pathway by negative pressure at a second fluid pump rate in response to a reduction in one or more of temperature and humidity at a treatment zone, wherein the second fluid pump rate is less than the first fluid pump rate, wherein the operation of the fluid pump to pump fluid out of the fluid pathway by negative pressure at the second fluid pump rate includes configuring at least one flow restriction member to restrict a flow of the fluid pumped by the fluid pump, and wherein the at least one flow restriction member includes an adjustable cover plate couplable to an exterior end face of the pump to at least partially cover an exhaust opening or vent on the fluid pump.

11. The method according to claim 10, further comprising varying a pump rate of the fluid pump to provide a controlled temperature reduction at the treatment zone.

12. The method according to claim 10, wherein the operation of the fluid pump to pump fluid out of the fluid pathway by negative pressure at the second fluid pump rate includes adjusting a power supplied to the fluid pump.

13. The method of claim 10, further comprising operating the fluid pump at the first pump rate when a patient position on the coverlet is: perspiring, has a skin relatively humidity of about 100% and/or liquid is present at the treatment zone.

14. The method of claim 13, wherein the first fluid pump rate is about 12 CFM to about 25 CFM to achieve a MVTR of at least about 450 $gm/m^2/hr$.

15. The method of claim 10, further comprising operating the fluid pump at the second pump rate when a patient position on the coverlet is: not perspiring, has a skin relatively humidity of less than about 100% and/or no liquid is present at the treatment zone.

16. The method of claim 15, wherein the second pump rate is less than about 1 CFM.

17. A method of moisture control, comprising:

operating a fluid pump of a moisture control coverlet to pump fluid out of a fluid pathway in the moisture control coverlet by negative pressure; and regulating the pump rate in response to a determination as to a resistance to heat transfer of a patient's skin, wherein the operation of the fluid pump includes configuring at least one flow restriction member to restrict a flow of the fluid pumped by the fluid pump, and wherein the at least one flow restriction member includes an adjustable cover plate couplable to an exterior end face of the pump to at least partially cover an exhaust opening or vent on the fluid pump.

* * * * *